United States Patent [19]

Lee et al.

[11] 4,432,475

[45] Feb. 21, 1984

[54] AUTOMATIC WASH TANK DRAIN/FILL APPARATUS FOR PROCESSOR OF PHOTOSENSITIVE MATERIAL

[75] Inventors: Conrad E. Lee, Golden Valley; Jerry A. Caflisch, Minneapolis, both of Minn.

[73] Assignee: Pako Corporation, Minneapolis, Minn.

[21] Appl. No.: 321,913

[22] Filed: Nov. 16, 1981

[51] Int. Cl.[3] ..... B22D 37/00; B08B 3/00

[52] U.S. Cl. ..... 222/509; 222/510; 222/518; 134/56 D

[58] Field of Search ..... 222/153, 483, 484, 509, 222/510, 511, 518; 141/344, 345, 364, 365, 366; 251/144; 292/130, 136; 134/56 D, 56 R, 143, 57 R, 58 R; 354/324

[56] References Cited

U.S. PATENT DOCUMENTS

| | | | |
|---|---|---|---|
| 2,492,917 | 12/1949 | Courtot | 222/498 X |
| 2,583,001 | 1/1952 | Magers | 222/518 X |
| 4,051,858 | 10/1977 | Mele | 134/56 R |

FOREIGN PATENT DOCUMENTS

| | | | |
|---|---|---|---|
| 1083652 | 6/1960 | Fed. Rep. of Germany | 354/324 |

*Primary Examiner*—Joseph J. Rolla
*Assistant Examiner*—Michael S. Huppert
*Attorney, Agent, or Firm*—Kinney, Lange, Braddock, Westman and Fairbairn

[57] ABSTRACT

A processor of photosensitive material having a plurality of tanks for containing fluids, one of which is a wash tank for containing wash water, and a top cover, including a movable front portion for covering the tanks when the processor is in operation is provided with a spring-loaded valve for controlling draining of wash water from the wash tank. The spring-loaded valve includes a U-shaped spring attached to the top of the wash tank. Connected to the spring is a plunger which extends vertically down into the drain hole. The plunger is equipped with a gasket for sealing the drain hole when the cover is in its lowered closed position. The spring has an adjustable striker extending upward to contact the bottom of the processor cover. When the processor cover is in its normal operating position, the striker is depressed and the spring is compressed. This seals the gasket against the bottom of the tank and prevents draining. When the front portion of the top cover is removed so that it no longer contacts the striker, the spring expands, lifting the plunger and opening the drain.

25 Claims, 6 Drawing Figures

Fig. 1
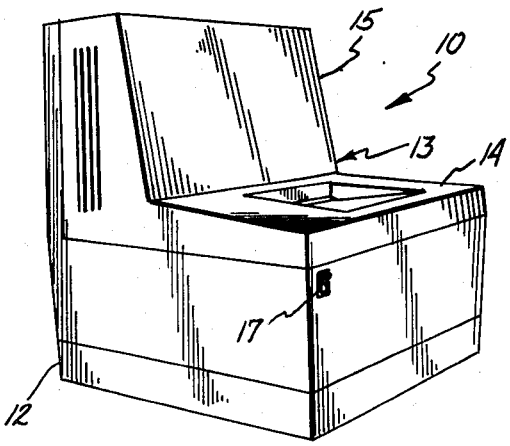
Fig. 2
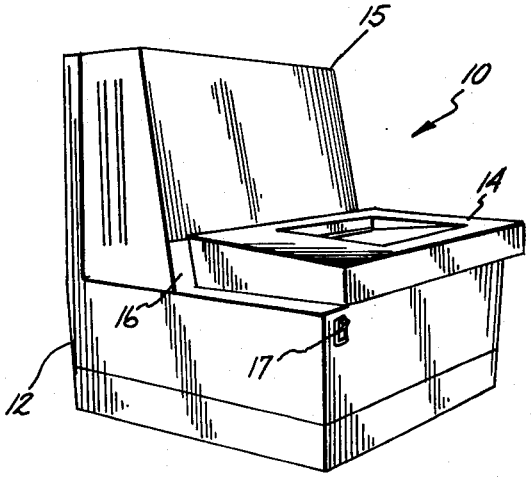
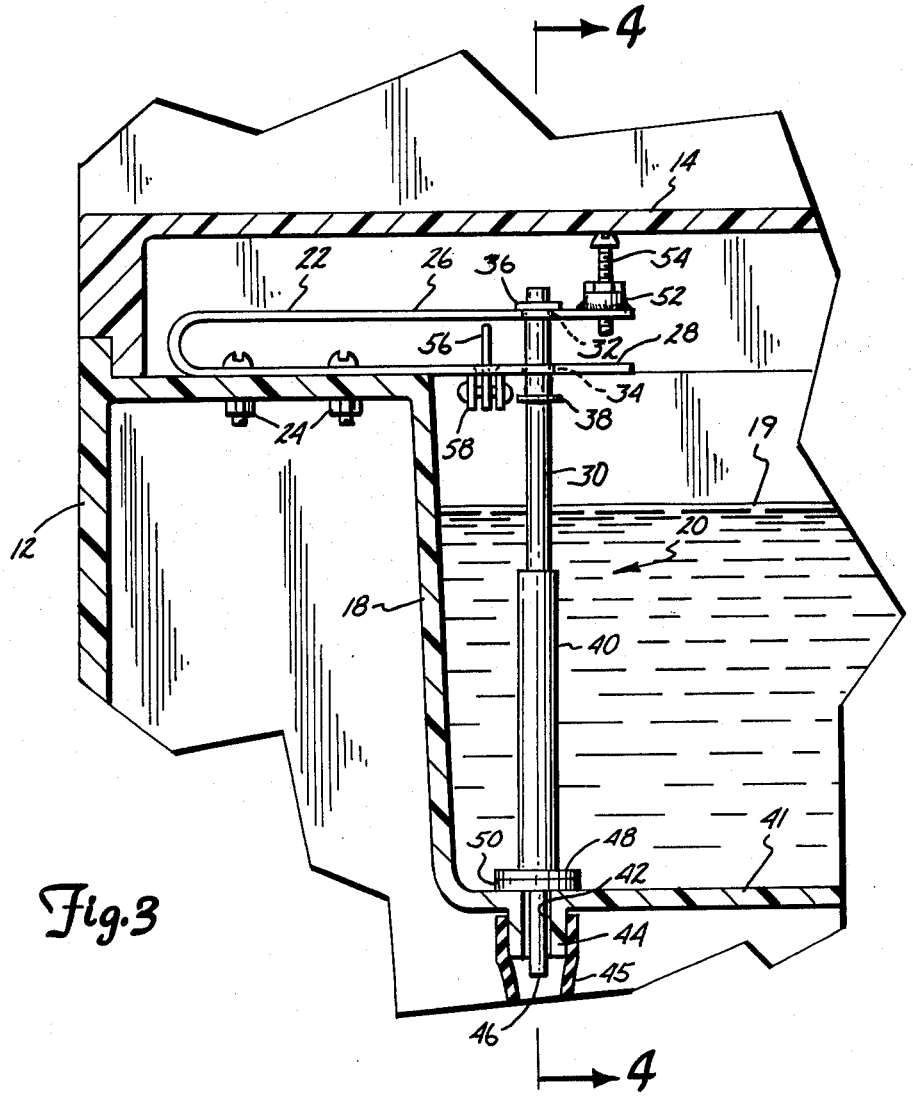
Fig. 3

AUTOMATIC WASH TANK DRAIN/FILL APPARATUS FOR PROCESSOR OF PHOTOSENSITIVE MATERIAL

BACKGROUND OF THE INVENTION

1. Field of the Invention

This invention relates to drain/fill apparatus for the wash tank of a processor of photosensitive material.

2. Description of the Prior Art

Certain processors of photosensitive material (e.g. x-ray film processors) have top covers which are opened at the end of the day, when the processor is shut off, so that potentially corrosive fumes inside of the processor may be exhausted. These fumes are allowed to escape during the night when the processor is not in operation. After the processor cover is opened, the wash tank preferably is drained to prevent the buildup of algae in the tank. When algae builds up on stagnant rollers, the rollers get slimy and the film transported by the rollers gets dirty. In the prior art, this draining is accomplished manually. The operator either manually opens a valve, or there is a microswitch and solenoid provided for opening the valve. The draining of the wash tank is always accomplished by this separate step.

SUMMARY OF THE INVENTION

A processor of photosensitive material having a plurality of tanks for containing fluids, one of which is preferably a wash tank for containing wash water, and having a cover, with a movable portion, for covering the tanks when the processor is in operation, is equipped with a valve which is responsive to the position of the top cover. The valve has a closed state which prevents draining of the wash tank when the cover is in its normal (i.e. closed) operating position, and has an open state which permits draining of the wash tank when the portion of top cover is displaced (i.e. opened) from its normal operating position. As a result, automatic draining of the wash tank occurs when the cover is opened at the end of a day to vent fumes.

The apparatus preferably includes bias means which biases the valve to its open state when the cover is opened and means responsive to the position of the cover for positioning the valve in its closed state to prevent draining when the cover is placed in its normal (closed) operating position. In one preferred embodiment, the valve includes a plunger which engages a drain hole in the bottom of the wash tank. It is equipped with a gasket for sealing against the bottom around the drain hole.

In preferred embodiments, the bias means is a spring which urges the valve to its open state. The spring is a U-shaped flexible member. The means responsive to the position of the top cover includes an adjustable striker extending upward from a top leg of the U-shaped spring to engage the top cover. When the portion of top cover is moved from its normal operating position, the striker no longer engages the top cover and the spring expands and lifts the plunger from the drain hole. When the top cover is put in its normal operating position, the bottom of the top cover engages and depresses the striker. This compresses the spring and allows the plunger to drop down and close the drain hole.

The apparatus also preferably has a latch means for holding the spring in its compressed state. This allows removal of the top cover for servicing the processor without draining the wash tank.

The apparatus of the present invention eliminates the extra step required to drain the wash tank in the prior art. The operator can never forget to drain the wash tank because the wash tank is automatically drained whenever the top cover is pulled back to exhaust the fumes. When use of the processor resumes, and the cover is pushed to its operating position, the valve is closed to allow filling of the tank.

BRIEF DESCRIPTION OF THE DRAWINGS

FIG. 1 is a perspective view of a processor of photosensitive material with its cover in a normal closed operating position.

FIG. 2 is a perspective view of the processor of photosensitive material with its cover slid forward in an open position.

FIG. 3 is a sectional view of the wash tank and cover showing the drain apparatus of the present invention.

DETAILED DESCRIPTION OF THE PREFERRED EMBODIMENTS

Figure 4:
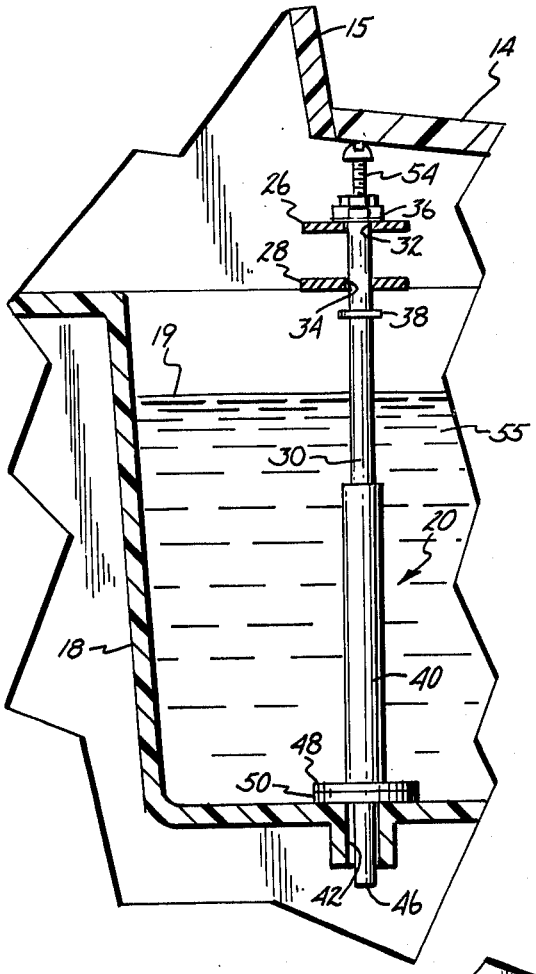
FIG. 4 is a sectional view along line 4—4 of FIG. 3 showing the drain apparatus in its closed state.

A processor of photosensitive material 10 is shown in FIG. 1. The example illustrated is a processor of medical X-ray film. Processor 10 has a base 12 and a top cover 13. Top cover has a movable front portion 14 and a back portion 15. Top cover 13 is shown in its normal closed operating position. In this position, top cover 13 covers a plurality of tanks (not shown) which are enclosed in base 12.

FIG. 2 shows processor 10 with front portion 14 in its open position. Front portion 14 is shown slid forward so that a gap 16 is formed between it and back portion 15. At the end of the operating period (e.g. at the end of a workday), the operator turns off on/off switch 17 and slides top 14 to this forward open position. The potentially corrosive fumes that are generated within the processor 10 during operating tims escape through gap 16 during the night or other nonoperating period.

FIG. 3 shows a cross sectional view of a wash tank 18, which holds wash water 19. Wash tank 18 is mounted in base 12 and is covered by top cover 13. In FIG. 3, top cover 13 is shown with front portion 14 closed. Mounted on wash tank 18 is drain apparatus 20. A bias means or spring 22 is attached to wash tank 18 by fasteners 24. Spring 22 is preferably a U-shaped piece of flexible spring steel, having a top leg 26 and a bottom leg 28. A plunger arm 30 passes through openings 32 and 34 in legs 26 and 28, respectively. A top clip 36 attached to plunger arm 30 restrains downward movement of plunger arm 30 through opening 32 in top leg 26. A bottom clip 38 attached to plunger arm 30 prevents plunger arm 30 from moving too far up through opening 34 by engaging the bottom leg 28 of spring 22 when the front portion of 14 top cover 13 is moved (see FIG. 6). The end of plunger arm 30 is attached to plunger 40 to form an integral vertical unit.

Wash tank 18 has a bottom 41 which is provided with a drain hole 42 and a drain nipple 44. Tubing 45 is mounted on drain nipple 44 and provides a conduit for carrying away wash water 19 drained from wash tank 18 through drain hole 42. The drain nipple 44 surrounds and extends below drain hole 42. Plunger 40 has a pilot 46 which slides up and down in drain hole 42 and guides plunger 40 into its proper closed position. Radially surrounding the end of plunger 40 is a drain cap 48. Attached to the underside of drain cap 48 is a gasket 50. When plunger 40 is in its lowered position, drain cap 48 compresses gasket 50 against the bottom 41 to seal around drain hole 42.

Attached to the top leg 26 of spring 22 is a mounting nut 52. Mounting nut 52 is internally threaded to receive a threaded bolt 54 or other means responsive to contact with front portion 14 of top cover 13. The height of bolt 54 is adjusted by turning the striker 54. Bolt 54 acts as a striker which contacts and is held down by front portion 14, as shown in FIG. 3, when the top cover 13 is closed.

Figure 5:
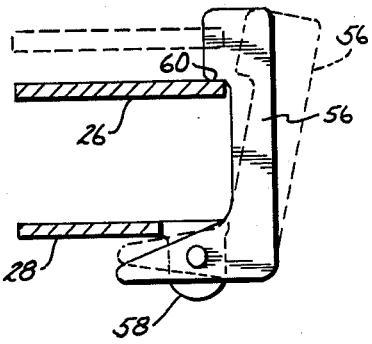
FIG. 5 is a sectional view of the spring showing latch means for holding the spring in its compressed position.

The operation of drain apparatus 20 is further illustrated in FIGS. 4 and 5. FIG. 4 shows drain apparatus 20 in its closed state. Front portion 14 of top cover 13 is contacting striker bolt 54, which compresses spring 22 by pressing down on top leg 26. This allows plunger 40 to drop by the force of gravity, so that drain cap 48 seats gasket 50 around drain hole 42. This seals drain hole 42 and prevents draining of wash water 19. This is the normal operating position.

Figure 6:
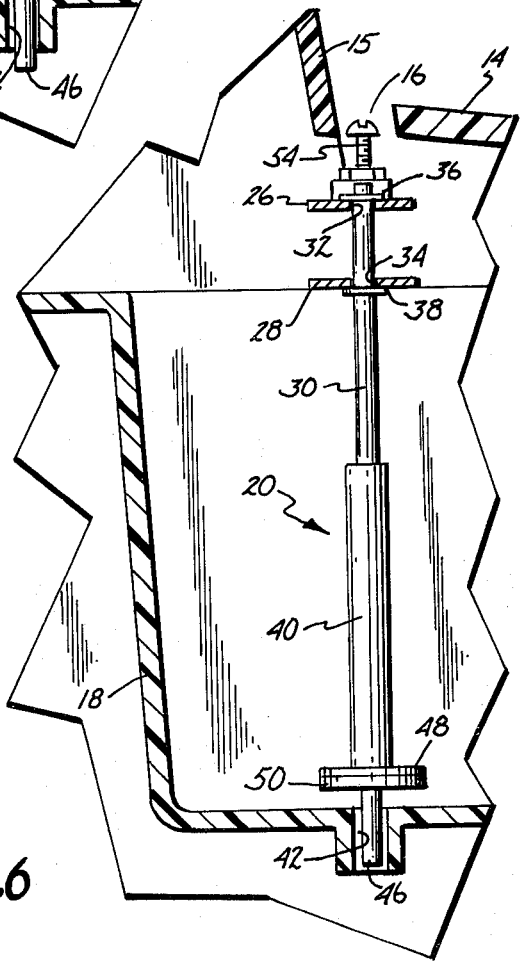
FIG. 6 is a sectional view taken along the same line 4—4 as FIG. 4, but showing the top cover displaced and the drain apparatus in its open state.

When operation is completed for the day and the front portion 14 of top cover 13 is moved away to exhaust fumes, as shown in FIG. 6, front portion 14 no longer contacts bolt 54. Top leg 26 rises because it is no longer compressed by bolt 54. Top leg 26 lifts top clip 36. This lifts plunger arm 30 and plunger 40 until clip 38 engages lower leg 28 of spring 22. Gasket 50 is no longer pressed against the bottom 41 so that drain hole 42 is opened, which allows wash water 19 to drain.

This invention also simplifies refilling of wash tank 18. When the front portion 14 of cover 13 is replaced at the beginning of a new day, the wash tank 18 will be ready to fill since the drain apparatus 20 is returned to its closed state. On/Off switch 17 is turned on by the operator, which actuates a fill solenoid valve (not shown) used to fill wash tank 18. Water flows into wash tank 18 for a predetermined time interval, after which the fill solenoid valve shuts off. If wash tank 18 is overfilled, the excess wash water flows into an overflow outlet to be drained away.

FIGS. 3 and 5 show the operation of a latch 56, which permits removal of front portion 14 of top cover 13 without draining wash tank 18. This is desirable when maintenance of the processor 10 is to be performed. Latch 56 is pivotally attached to a mounting bracket 58, which is attached to bottom leg 28. The normal unlatched position for latch 56 is shown in phantom in FIG. 5. If the operator or service technician desires to open top cover 13 for maintenance without draining wash water 19, latch 56 is used to hold spring 22 in a compressed state so that plunger arm 30 and plunger 40 are not lifted when front portion 14 is removed. Front portion 14 of top cover 13 is opened. The operator then swings latch 56 to its upright latched position, shown in solid lines in FIG. 5. The drain rate is slow enough so that any drainage of wash water 19 during the closing of latch 56 is minimal and inconsequential. Lip 60 of latch 56 engages top leg 26, which holds spring 22 in its compressed position. Latch 56 is held in its latched position by the tension of leg 26 pressing against lip 60. If further pressure is applied in downward direction on top leg 26, lip 60 is no longer held and latch 56 pivots away by its own weight. Latch 56 has most of its weight to the outside of the pivotal attachment to mounting bracket 58, so the normal rest position is away from leg 26. Therefore, if latch 56 is in its closed position while the front portion 14 of top cover 13 is open, the repositioning of front portion 14 of top cover 13 in its normal operating position will push down on striker bolt 54 and compress spring 22 enough to remove the tension against lip 60. This automatically releases latch 56, even if the operator or service technician has forgotten to release latch 56.

In conclusion, the apparatus of the present invention eliminates from the operator's procedure the step of manually draining the wash tank 18. Because the wash tank 18 is not visible to the operator, it is an easy step to forget. With this invention, the wash tank 18 will be drained automatically as the top cover 14 is moved to provide venting of fumes.

Although the present invention has been described with reference to preferred embodiments, workers skilled in the art will recognize that changes may be made in form and detail without departing from the spirit and scope of the invention.

What is claimed is:

1. A drain apparatus for a processor of photosensitive material comprising:

a tank for containing fluid;

a movable cover having an operating position covering the tank when the processor is in operation and being displaceable from the operating position to permit venting of an interior portion of the processor when the processor is not in operation;

a valve for draining fluid from the tank, the valve having an open state which permits draining and a closed state which prevents draining;

bias means for biasing the valve to its open state;

means responsive to the position of the cover for maintaining the valve in its closed state when the cover is in its operating position covering the tank and permitting the bias means to bias the valve to its open state when the cover is displaced from its operating position.

2. The apparatus of claim 1 wherein the bias means is a spring.

3. The apparatus of claim 2 wherein the spring is a U-shaped flexible member.

4. The apparatus of claim 1 wherein the means responsive to the position of the cover is a vertical member attached to the bias means, which is engaged and depressed by the cover when the cover is in its operating position.

5. The apparatus of claim 4 wherein the bias means is a U-shaped spring with an upper leg and a lower leg and the vertical member is attached to and extends upward from the upper leg to be contacted and depressed by the cover when the cover is in its operating position.

6. The apparatus of claim 1, 4 or 5 wherein the valve comprises a plunger operably connected to the bias means for extending into and plugging a drain hole in the tank when the valve has its closed state and being movable by the bias means to a position which permits fluid flow through the drain hole when the valve has its open state.

7. The apparatus of claim 4 or 5 wherein the vertical member is an adjustable striker having an upper end for engaging an inner surface of the cover.

8. The apparatus of claim 1 further comprising latch means manually operable to a latching position for holding the bias means in a state in which the valve is in its closed state even though the cover is displaced from is operating position.

9. The apparatus of claim 8 wherein the means responsive to the position of the cover causes the latch means to be released from the latching position when the cover is replaced to its operating position.

10. In a processor of photosensitive material having an interior chamber in which is located a wash tank for containing wash water and having a movable cover which has an operating position for covering the interior chamber when the processor is in operation, and which is displaceable from the operating position to permit venting of fumes from the interior chamber when the processor is not in operation, the improvement comprising:

spring biased valve means for controlling draining of wash water from the wash tank, the spring biased valve means being engaged by and maintained by the cover in a closed state which prevents draining of wash water from the wash tank when the cover is in its operating position, and the spring biased valve means moving out of engagement with the cover and attaining an open state which permits draining of wash water from the wash tank when the cover is displaced from its operating position.

11. The invention of claim 10 wherein the spring biased valve means comprises:

a movable member having a first position which prevents draining and a second position which permits draining;

cover engaging means for engaging the cover and applying a force which causes the movable member to move to the first position when the cover is in its operating position; and spring bias means for applying a bias force to the movable member when the cover is displaced from its operating position to cause the movable member to move to the second position.

12. The invention of claim 11 wherein the cover engaging means comprises a striker having an end which engages an inner surface of the cover.

13. The invention of claim 12 wherein the striker is operably connected to the spring bias means to apply a force which opposes and overcomes the bias force when the cover is in its operating position.

14. The invention of claim 13 wherein the spring bias means has a generally horizontal flexible member, wherein the striker is a generally vertical member attached to and extending upward from the flexible member, wherein the movable member is operably connected to the flexible member so that the position of the movable member is determined by the position of the flexible member.

15. The invention of claim 14 wherein the movable member is a generally vertical plunger extending downward from the flexible member and having a lower end which plugs a drain hole in the wash tank when the movable member is in the first position and which permits fluid flow through the drain hole when the movable member is in the second position.

16. The invention of claim 15 wherein the striker applies a downward force to depress the flexible member and permit the plunger to move downward to the first position when the cover is in its operating position, and wherein the flexible member applies the bias force in an upward direction to lift the plunger to the second position when the cover is displaced from its operating position.

17. The invention of claim 16 and further comprising:

latch means manually settable to engage and depress the flexible member even though the cover is displaced from its operating position.

18. The invention of claim 17 wherein the striker further depresses the flexible member to release the latch means when the cover is replaced to its operating position.

19. In a processor of photosensitive material having an interior chamber in which is located a wash tank for containing wash water, and having a movable cover with an operating position for covering the interior chamber when the processor is in operation and being movable from the operating position to a position which permits venting of fumes from the interior chamber when the processor is not in operation, the improvement comprising:

a valve for draining wash water from the wash tank, the valve having an open state which permits draining and a closed state which prevents draining;

bias means for biasing the valve to its open state;

means responsive to the position of the cover for maintaining the valve in its closed state when the cover is in its operating position covering the tanks and permitting the bias means to bias the valve to its open state when the cover is displaced from its operating position.

20. The invention of claim 19 wherein the valve is a movable plunger having a lower end which plugs a drain hole in the wash tank when the valve is in its closed state and which permits fluid flow through the drain hole when the valve is in its open state.

21. The invention of claim 20 wherein the bias means includes a generally horizontal flexible member operably connected to the movable plunger, and wherein the means responsive to the position of the cover is a striker attached to and extending upward from the flexible member and having an upper end for engaging an inner surface of the cover when the cover is in its operating position.

22. In a processor of photosensitive material having an interior chamber in which is located a wash tank for containing wash water, and having a movable cover which has an operating position for covering the interior chamber when the processor is in operation and being movable from its operating position to permit venting of fumes from the interior chamber when the processor is not in operation, the improvement comprising:

valve means responsive to the position of the cover, the valve means having a closed state which prevents draining of wash water from the wash tank when the cover is in its operating position and having an open state which permits draining of wash water from the wash tank when the cover is displaced from its operating position.

23. The invention of claim 22 wherein the valve means comprises:

a movable member having a first position which prevents draining and a second position which permits draining; and means responsive to the position of the cover for causing the movable member to move to the first position when the cover is moved to its operating position and causing the movable member to move to the second position when the cover is displaced from its operating position.

24. The invention of claim 23 wherein the means responsive to the position of the cover comprises:

cover engaging means for engaging the cover and applying a force which causes the movable member to move to the first position when the cover is moved to its operating position; and spring bias means for applying a bias force to the movable member when the cover is displaced from its operating position to cause the movable member to move to the second position.

25. The invention of claim 24 wherein the movable member is a plunger which plugs a drain hole in the wash tank when in the first position and which permits fluid flow through the drain hole when in the second position.

* * * * *